United States Patent [19]

Kahl, Jr. et al.

[11] Patent Number: 4,884,734

[45] Date of Patent: Dec. 5, 1989

[54] TAPE DISPENSER

[75] Inventors: John J. Kahl, Jr., Fairview Park; Brian A. Vulpitta, Avon Lake; Thomas A. Corbo, Gates Mills; Craig M. Saunders, Sagamore Hills; John R. Nottingham, Moreland Hills, all of Ohio

[73] Assignee: Manco, Inc., Cleveland, Ohio

[21] Appl. No.: 47,936

[22] Filed: May 8, 1987

[51] Int. Cl.[4] ..... B26F 3/02

[52] U.S. Cl. ..... 225/26; 225/33; 225/42; 225/46; 225/66; 225/77

[58] Field of Search ..... 225/25, 26, 33, 42, 225/66, 77, 46; 206/818

[56] References Cited

U.S. PATENT DOCUMENTS

| | | | |
|---|---|---|---|
| D. 118,629 | 1/1940 | Reinecke . | |
| D. 125,085 | 2/1941 | Jackson . | |
| D. 144,214 | 3/1946 | Preble, Jr. | D74/1 |
| D. 144,392 | 4/1946 | Krueger | D74/1 |
| D. 144,865 | 5/1946 | Mason | D74/1 |
| D. 145,699 | 10/1946 | Preble, Jr. | D74/1 |
| D. 147,582 | 9/1947 | Dailey | D74/1 |
| D. 150,160 | 7/1948 | Salsbury | D58/12 |
| D. 164,733 | 10/1951 | Pretzfelder, Jr. | D74/1 |
| D. 177,224 | 3/1956 | Gershen | D74/1 |
| D. 179,091 | 10/1956 | Pangburn | D74/1 |
| D. 185,284 | 5/1959 | Hofmann | D74/1 |
| D. 187,765 | 4/1960 | Gershen | D74/1 |
| D. 188,150 | 6/1960 | Gershen | D74/1 |
| D. 190,978 | 7/1961 | Trombly, Jr. | D74/1 |
| D. 198,958 | 8/1964 | Larson | D74/1 |
| D. 202,949 | 11/1965 | Petterson | D74/1 |
| D. 207,468 | 4/1967 | Addis | D74/1 |
| D. 209,356 | 11/1967 | Le Merle | D74/1 |
| D. 226,334 | 2/1973 | Reinecke | D74/1 |
| D. 226,358 | 2/1973 | Caldwell | D74/1 |
| D. 227,175 | 6/1973 | Finkel | D74/1 B |
| D. 238,360 | 1/1976 | Gibbs | D19/69 |
| D. 239,620 | 4/1976 | Fritzinger | D19/69 |
| D. 242,452 | 11/1976 | Brown, Sr. | D19/69 |
| D. 245,914 | 9/1977 | Fritzinger | D19/69 |
| D. 259,643 | 6/1981 | Pearson | D19/69 |
| 897,086 | 8/1908 | Grand . | |
| 1,837,180 | 12/1931 | Bennett, Jr. et al. . | |
| 2,145,506 | 1/1939 | De Matti | 164/45 |
| 2,262,260 | 11/1941 | Smith | 30/126 |
| 2,295,477 | 8/1942 | Jackson | 242/55.5 |
| 2,295,679 | 9/1942 | Montbach | 242/55.5 |
| 2,414,915 | 1/1947 | Ziegler | 225/33 |
| 2,592,865 | 4/1952 | Corey | 164/84.5 |
| 2,640,656 | 6/1953 | Donkin | 242/55.5 |
| 2,664,252 | 12/1953 | Glew | 242/55.5 |
| 2,673,042 | 3/1954 | Fritzinger | 242/55.5 |
| 2,676,658 | 4/1954 | King | 164/84.5 |
| 2,759,545 | 8/1956 | Rizza | 225/34 |
| 2,805,714 | 9/1957 | Vogt | 164/58 |
| 2,854,682 | 10/1958 | Berezny | 15/104 |
| 3,016,174 | 1/1962 | Perkins | 225/47 |
| 3,109,570 | 11/1963 | Maddalena | 225/66 |
| 3,134,526 | 5/1964 | Schleicher | 225/56 |
| 3,149,764 | 9/1964 | Waltz | 225/57 |

(List continued on next page.)

FOREIGN PATENT DOCUMENTS

| | | |
|---|---|---|
| 1258762 | 7/1988 | Fed. Rep. of Germany . |
| 2061225 | 5/1981 | United Kingdom . |
| 2104871 | 3/1983 | United Kingdom . |

OTHER PUBLICATIONS

Deflecto-o Magnetic Tape Dispenser as cited by applicants received Nov. 2, 1987.

*Primary Examiner*—Douglas D. Watts
*Assistant Examiner*—Rinaldi Rada
*Attorney, Agent, or Firm*—Body, Vickers & Daniels

[57] ABSTRACT

A small, lightweight ornamental tape dispenser is adapted for hand held, desk top, or wall mounted use, and accomodates both right and left handed withdrawal of tape while remaining in a wall mounted position. A wall mounting means, a tape roll holding means, and a free standing base means are disposed at the rear side of an ornamental planar front wall member.

17 Claims, 3 Drawing Sheets

U.S. PATENT DOCUMENTS

| | | | |
|---|---|---|---|
| 3,158,303 | 11/1964 | Pepitto | 225/66 |
| 3,159,322 | 12/1964 | Martin | 225/56 |
| 3,193,433 | 7/1965 | Tillotson | 156/527 |
| 3,417,935 | 12/1968 | Douglas et al. | 242/55.2 |
| 3,484,030 | 12/1969 | Mattheis | 325/65 |
| 3,502,252 | 3/1970 | Mariani | 225/33 |
| 3,565,727 | 2/1971 | Guest | 156/527 |
| 3,623,643 | 11/1971 | Ikeda | 225/65 |
| 3,684,141 | 8/1972 | Hall | 225/65 |
| 3,696,980 | 10/1972 | Waltz | 225/66 |
| 3,762,261 | 10/1973 | Ekenberg | 83/649 |
| 3,970,230 | 7/1976 | Horn | 225/65 |
| 3,993,230 | 11/1976 | Oakes | 225/47 |
| 4,108,513 | 8/1978 | Lander | 312/39 |
| 4,130,229 | 12/1978 | Pagnini | 225/33 |
| 4,570,837 | 2/1986 | Belokin | 225/42 |

FIG. 1
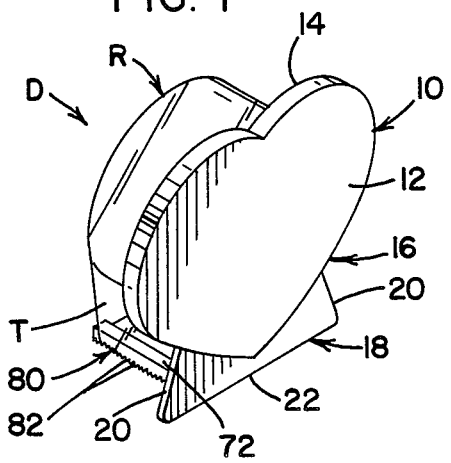
FIG. 2
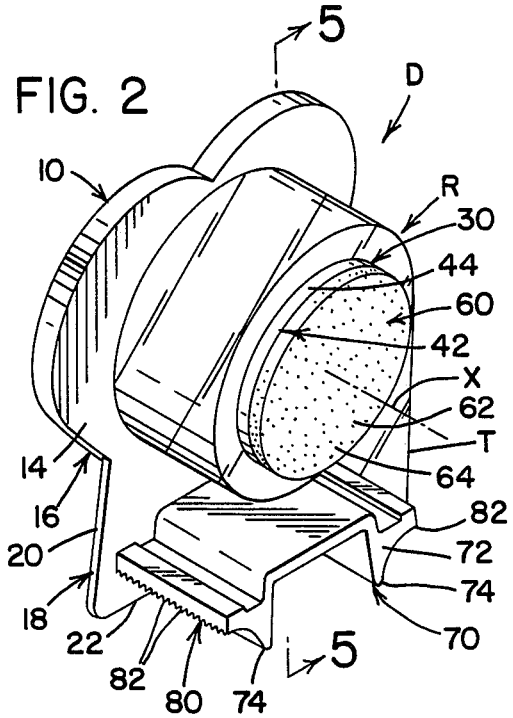
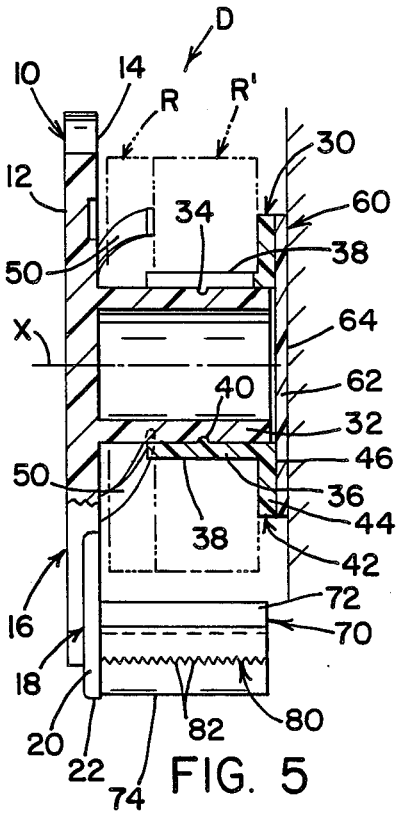
FIG. 5
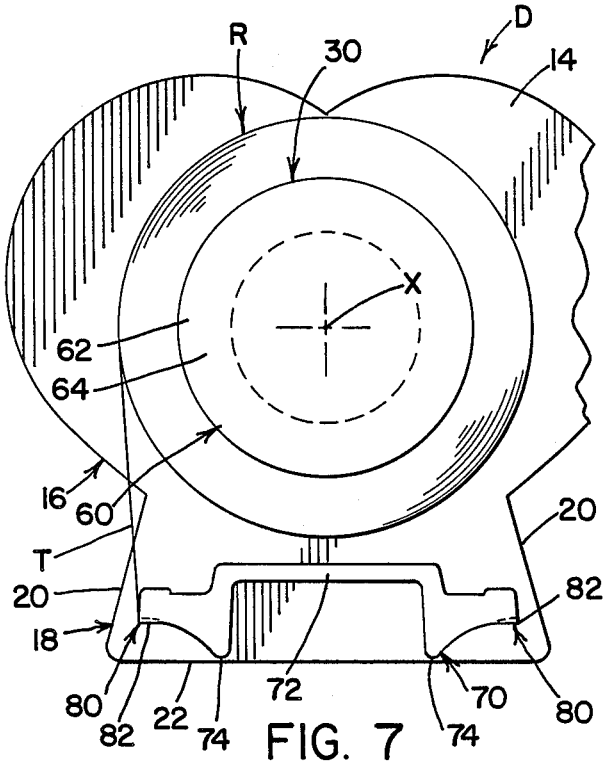
FIG. 7

TAPE DISPENSER

The present invention pertains to the art of tape dispensers and, more particularly, to an ornamental adhesive tape dispenser for hand held, desk top, or wall mounted use.

BACKGROUND OF THE INVENTION

Adhesive tape for general household or office use is usually held in a dispenser, which may be a small, hand held device or a relatively larger desk top appliance.

Hand held tape dispensers are typically formed as a shell comprising two parallel side walls each having a generally circular body portion and a forward extending portion. The side walls are connected at their edges by a front wall, a rear wall, and a base upon which the dispenser can stand upright. A hub extends between the body portions of the side walls in a direction perpendicular thereto, and a tape cutter in the form of a serrated edge likewise extends between the forward portions at a position atop or above the front wall. A roll of tape is rotatably carried on the hub to be unwound toward the cutting edge.

Desk top tape dispensers typically comprise a solid massive body of elongate shape. An elongate slot or recess sized to accommodate a standard roll of tape extends downwardly from the upper surface of the dispenser body. A removable hub adapted to support a roll of tape is rotatably supported within the slot. A tape cutter is provided at the forward end of the dispenser. The cutter is normally a small piece of metal having a serrated forward edge performing two functions. It allows one to cut off the length of tape desired and also acts as a keeper retaining the end of the remaining roll of tape for subsequent dispensing.

Each of these known tape dispensers has several disadvantages. The most inconvenient and wasteful disadvantage of hand held tape dispensers is the tendency of such devices to become misplaced during use. A hand held dispenser is necessarily small and lightweight, and thus is easily hidden from view beneath documents or other items found at the workplace or home. This is a particular problem in the home where hand held tape dispensers left on the floor of a child's room or a workshop are often lost or stepped upon and broken.

Also, hand held tape dispensers for home or office use are disposable, and thus rigidly hold one tape roll of standard width. This limitation requires the user to purchase a separate unit for each size and type of tape desired, and further causes waste of the tape roll remaining when a dispenser is broken.

Disadvantages of known desk top tape dispensers primarily involve their size and weight. As noted above, such appliances are designed to remain in place on the desk surface. While satisfactory in some circumstances, such as an office mailroom, these dispensers cannot conveniently be moved about as may be required in a busy working environment, and are not suitable for sporadic household use. The required size and weight of desk top tape dispensers contributes to their expense, which is a multiple of the cost of hand held dispensers.

A further disadvantage common to all known tape dispensers is the especially unsightly appearance thereof. Hand held dispensers are most often composed of clear plastic exposing both the tape roll an advertising print to view. These items are not kept in a readily visible location in either the home or the office. Instead, they are stored out of sight in drawers, closets, or on shelves where they are both inconveniently out of reach and easily lost or broken. Known desk top tape dispensers also expose the tape roll to view, and have a neutral and indistinct appearance with no appeal as a household item.

Known tape dispensers are thus seen to fail to provide an inexpensive and convenient device which is also visually attractive. For this reason, known tape dispensers have no special appeal as gifts or children's school supply items and thus miss a very large commercial market.

THE INVENTION

The present invention contemplates a new and improved tape dispenser which overcomes all the above referred to problems and others and provides an ornamental tape dispenser for both household and office use which can be used as a hand held, desk top, or wall mounted appliance.

In accordance with the present invention there is provided a tape dispenser comprising a vertical planar front wall having a front and a rear side. The front side comprises an ornamental design. Disposed at the rear side is a cylindrical hub component extending horizontally from the front wall and being adapted to releaseably hold a roll of tape, a magnet at the rear end of the cylindrical hub adapted to mount the tape dispenser to a metallic wall surface, a base component extending horizontally from the front wall below the hub component and being adapted to support the tape dispenser in a free standing upright position, and a pair of tape cutting edges associated with the base component.

In accordance with one aspect of the invention the hub component of the tape dispenser is a cylindrical member extending horizontally from the middle region of the vertical front wall and is adapted to releaseably hold a roll of tape to be rotatable about the hub in a plane parallel to the front wall. The hub comprises a hollow cylindrical shaft fixed at one end to the front wall, and a cylindrical sleeve closely and releaseably receivable over the length of the shaft. A circular flange at the rear end of the sleeve is formed as a retainer to hold the tape roll axially on the hub between the front wall and the flange when the sleeve is received over the shaft.

In accordance with another aspect of the invention, the magnet at the rear end of the cylindrical hub component comprises a flat magnetic material attached to the rear surface of the circular flange. The flat magnetic mounting surface is the rearmost part of the tape dispenser.

Further in accordance with the invention, the base component of the tape dispenser extends horizontally from the rear side of the vertical front wall below the hub component and has two feet adapted to support the tape dispenser in a free standing upright position on a horizontal surface. The base is formed as a generally arcuate member facing vertically downward with the arcuate extremities thereof extending rearwardly and forming the feet. A rearwardly extending slot divides the base into two equal arcuate sectors. A length of tape unwound from the tape roll is directed downwardly through the slot. Associated with the base is a pair of parallel cutting arms extending rearwardly from the front wall beneath the slot. The cutting arms hold a parallel opposed pair of serrated tape cutting edges such that the unwound tape passing down through the slot continues vertically downward between the tape cutting edges and away from the dispenser. Clearance is provided between the cutting arms and the slot for a user's fingertips to grasp the tape.

Further in accordance with the invention, in an alternate embodiment of the tape dispenser the base component extends rearwardly from the vertical front wall and is formed as an adjacent pair of generally U-shaped members facing vertically downward. Each U-shaped member has a foot formed at the end of one arm of the U-shape, and a serrated tape cutting edge formed at the end of the other arm. The arms having feet are disposed adjacent one another and are spaced apart to provide a vertical passage through which an unwound length of tape is directed downwardly between the base members. The length of tape is then turned to extend laterally in either direction across the back of the tape dispenser to either of the two cutting edges.

In yet another embodiment of the tape dispenser the base extends rearwardly from the vertical front wall and is formed as a single U-shaped member facing vertically downward. The ends of the U-shape form a pair of parallel feet. A serrated tape cutting edge is provided vertically above and parallel to each foot.

Still further in accordance with the invention, a tape dispenser comprises a base positioned below a tape holding means and extending rearwardly from a front wall member. The base has a generally arcuate cross-section in a plane parallel to the wall member such that the arcuate extremities of the base from two parallel feet extending rearward from the wall member to support the tape dispenser in an upright, free standing position. The tape cutting means comprises a pair of tape cutting edges each disposed parallel to and vertically above one of the feet. The tape cutting means may be formed integrally with the base means.

The principal object of the present invention is to provide a new and improved tape dispenser which is convenient, attractive, and easy to use in both a household and office environment.

Another object of the present invention is to provide a tape dispenser which can be either releaseably magnetically mounted on a metal wall such as a filing cabinet or a home refrigerator, stood on a desk as a permanent piece of office equipment, or picked up and carried as a hand held appliance.

Another object of the invention is to provide a lightweight tape dispenser which can be magnetically mounted in place against a massive object thereby providing the advantages of both a lightweight inexpensive dispenser and a massive, expensive dispenser in an inexpensive package.

Still another object of the present invention is to provide a hand held tape dispenser which can accommodate a variety of tape rolls of varying width.

Yet another object of the present invention is to provide a tape dispenser for mounting on a refrigerator door, filing cabinet wall, or other like surface and which permits withdrawal of tape in either a right handed or left handed direction without the necessity of dismounting and reversing the dispenser each time a reversed direction of tape withdrawal is desired.

Another object of the present invention is to provide a tape dispenser which has marketing appeal not only as a utilitarian appliance but also as an attractive gift item for children or adults.

These and other objects and advantages of the present invention will become apparent from the following detailed description of a preferred embodiment thereof and from the accompanying drawings.

BRIEF DESCRIPTION OF THE DRAWINGS

In the drawings:

FIG. 1 is a front pictorial view of a tape dispenser holding a tape roll in accordance with a first embodiment of the present invention;

FIG. 2 is a rear pictorial view of the tape dispenser shown in FIG. 1;

FIG. 5 is a cross-sectional view taken on line 5—5 of FIG. 2;

FIG. 7 is a rear elevational view of the tape dispenser shown in FIG. 1;

DESCRIPTION OF A PREFERRED EMBODIMENT

Figure 3:
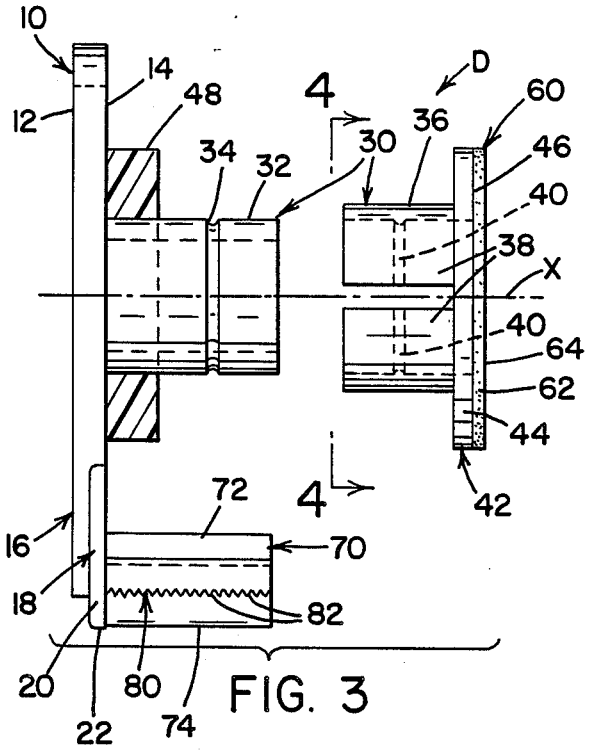
FIG. 3 is an exploded side elevational view of a tape dispenser in accordance with the present invention.
Figure 4:
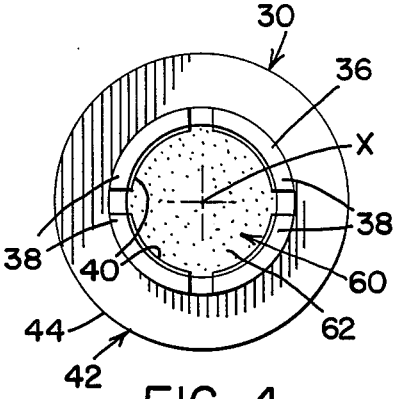
FIG. 4 is an elevational view taken on line 4—4 of FIG. 3.

Referring to the drawings wherein the showings are for the purpose of illustrating a preferred embodiment of the invention and not for the purpose of limiting same, FIG. 1 shows in front pictorial view a tape dispenser D holding a roll of adhesive tape R. Tape dispenser D comprises a substantially planar vertical front wall member 10 having a front side 12 and a rear side 14. The outline of wall member 10 is ornamental in design and in the preferred embodiment comprises a heart shaped upper section 16 supported on a lower section 18. Lower section 18 is generally trapezoidal in outline with side edges 20 converging upwardly from horizontal lower edge 22. Wall member 10 may take any ornamental configuration with or without a distinct supporting section. For example, the outline of wall member 10 may resemble a football, a star or the like, and may have a decorative color or pattern on front side 12.

In FIG. 2 there is shown in rear pictorial view the tape dispenser D shown in FIG. 1. Tape dispenser D further comprises tape roll holding means 30 disposed at rear side 14 of wall member 10 and adapted to releaseably and rotatably hold tape roll R, wall mounting means 60 disposed at the rear end of tape roll holding means 30 and adapted to magnetically mount tape dispenser D to a vertical surface, base means 70 disposed at rear side 14 of wall member 10 vertically below tape roll holding means 30 and adapted to support tape dispenser D in a free standing upright position on a horizontal surface, and cutting means 80 associated with base means 70 and adapted to cut the end of an unwound length of tape T and to hold tape T in an unwound position to be grasped by the user.

Referring now to FIG. 3 there is shown a side elevational view of a tape dispenser D in accordance with the present invention. In the preferred embodiment tape holding means 30 is formed as a hub component shaft 32, sleeve 36 and retainer means 42. Shaft 32 is a hollow cylindrical member extending rearwardly from wall member 10 and having an axis X perpendicular to wall member 10. The outside surface of shaft 32 is provided with circumferentially extending groove 34. Sleeve 36 is a hollow cylindrical member closely receivable over the length of shaft 32 and is formed as a series of axially extending cylindrical sectors 38. The inside surface of sleeve 36 is provided with rib 40. Rib 40 is interrupted between sectors 38 but is otherwise circumferentially extensive about the inner surface of sleeve 36. Retainer means 42 is formed as a circular flange 44 extending radially outward from the rear end of sleeve 36 and providing flat rear surface 46 in a plane parallel to wall member 10.

Still referring to FIG. 3, in the preferred embodiment wall mounting means 60 comprises a flat circular magnet 62 attached to rear surface 46 and providing flat wall mounting surface 64. Alternately, magnet 62 may be inserted within sleeve 36 to provide a wall mounting surface flush with rear surface 46 or rearwardly spaced therefrom. Magnet 62 is preferred to be composed of a soft or flexible elastomeric material having magnetic particles embedded therein so as not to scratch a metallic surface to which it is adhered. Such magnets are widely available commercially.

Tape roll R is held on sleeve 36 to rotate and unwind about axis X. As best seen in FIG. 5, sleeve 36 is received over shaft 32 with rib 40 releaseably engaged in groove 34. Sleeve 36 is formed as sectors 38 for this purpose such that sectors 38 flex radially outwardly from axis X to enable releaseable engagement of sleeve 36 over shaft 32. Alternately, a segmented shaft may be provided to releaseably engage with a unitary sleeve, and the rib and groove may be reversed between the sleeve and the shaft. Tape roll R is releaseably held axially on sleeve 36 by retainer means 42.

Figure 6:
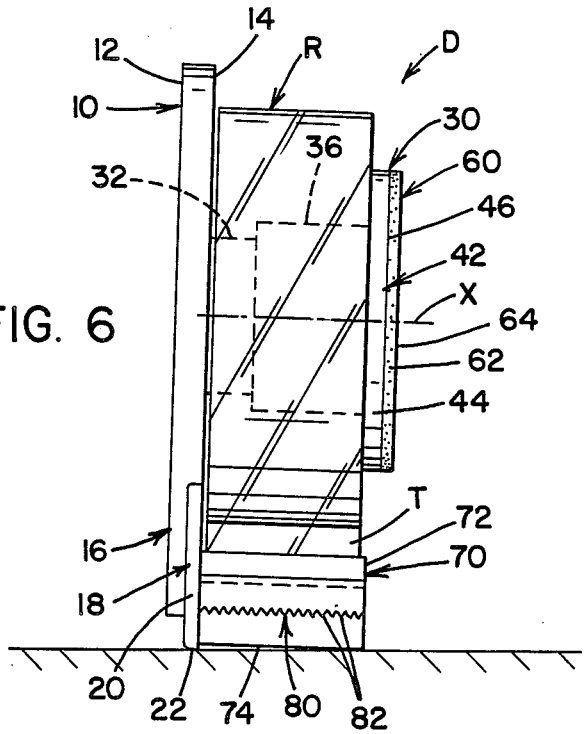
FIG. 6 is aside elevational view of a tape dispenser in accordance with the present invention.

Tape roll holding means 30 is adapted to accommodate tape rolls of varying width. It is preferred that a tape roll be firmly held to rotate in a plane parallel to wall member 10 and not to slide along axis X during unwinding. For this purpose, in the embodiment shown in FIG. 5, spring means 50 is provided to bias a relatively narrow tape roll R" axially along sleeve 36 to abut against flange 44. Alternately, spring means 50 may be provided on flange 44 to bias tape roll R" against rear side 14 of wall member 10. In the embodiment shown in FIG. 3, washer 48 is provided to space a relatively narrow tape roll axially along sleeve 36 to abut against flange 44. In FIG. 6 there is shown an embodiment of tape roll holding means 30 without a washer or spring means and holding a wide tape roll R firmly in position on sleeve 36.

Referring now to FIG. 2, there is shown a rear pictorial view of an embodiment of tape dispenser D wherein base means 70 comprises horizontal base member 72 extending rearwardly from wall member 10 vertically below tape roll holding means 30. Base member 72 is a generally U-shaped member facing vertically downwardly such that the ends of the U-shape form rearwardly extending feet 74. Feet 74 are adapted to support tape dispenser D in an upright, free standing position with wall member 10 substantially vertical as shown in FIG. 6.

In the embodiment shown in FIG. 2, cutting means 80 comprises cutting edges 82 formed integrally with base member 72 and being vertically above feet 74 and parallel to axis X. Cutting edges 82 are formed as rows of serrated teeth and are adapted to cut tape T and to hold an unwound length of tape T between roll R and cutting edges 82. Alternately, cutting edges 82 may comprise serrated metal strips in a well known manner.

Figure 8:
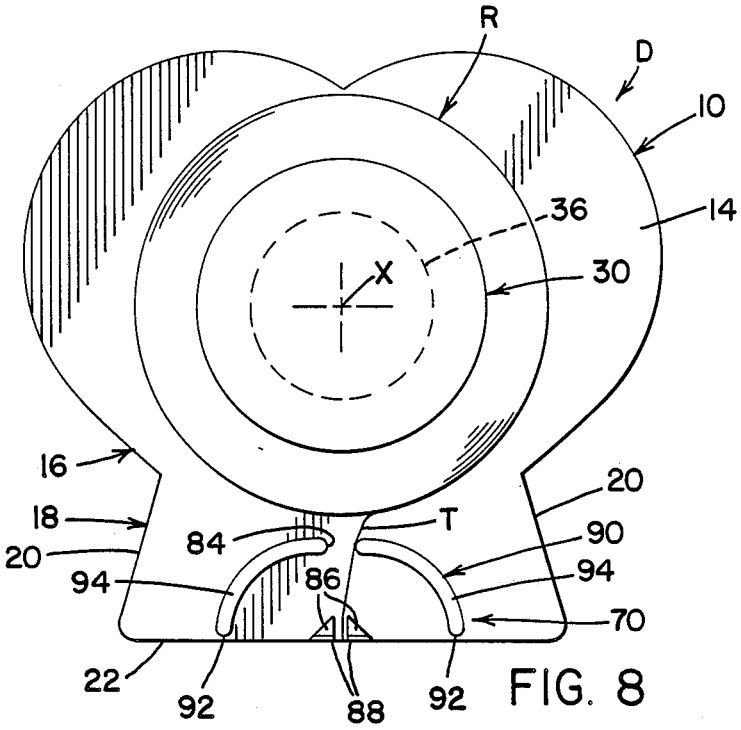
FIG. 8 is a rear elevational view of a second embodiment of a tape dispenser in accordance with the present invention; and, FIG. 9 a rear elevational view of a third embodiment of a tape in accordance with the present invention.

Referring to FIG. 8, there is shown an alternate embodiment of tape dispenser D wherein base means 70 comprises base component 90. Base component 90 extends rearwardly from wall member 10 below tape roll holding means 30 and has a generally arcuate cross-section in a plane parallel to wall member 10. The arcuate extremities of base component 90 form two rearwardly extending feet 92 adapted to support tape dispenser D in the above described manner.

The embodiment of cutting means 80 shown in FIG. 8 is associated with base means 70 with cutting means 80 comprising slot 84, cutting arms 86, and cutting edges 88. Slot 84 extends rearwardly from wall member 10 in a direction perpendicular thereto through base component 90 dividing base component 90 into two adjacent arcuate base members 94. Cutting arms 86 extend rearwardly from wall member 10 below slot 84, are preferred to be parallel, and are disposed as a pair on opposite sides of a vertical plane passing through slot 84. Cutting arms 86 hold a parallel pair of cutting edges 88 each adapted to cut tape T and to hold an unwound length of tape T between a cutting edge 88 and tape roll R, or between a cutting edge 88 and either of base members 94 at slot 84. Sufficient distance is provided between cutting arms 86 and base members 94 to permit a user to reach between cutting arms 86 and base members 94 to grasp a length of tape T held therebetween by cutting edges 88.

Figure 9:
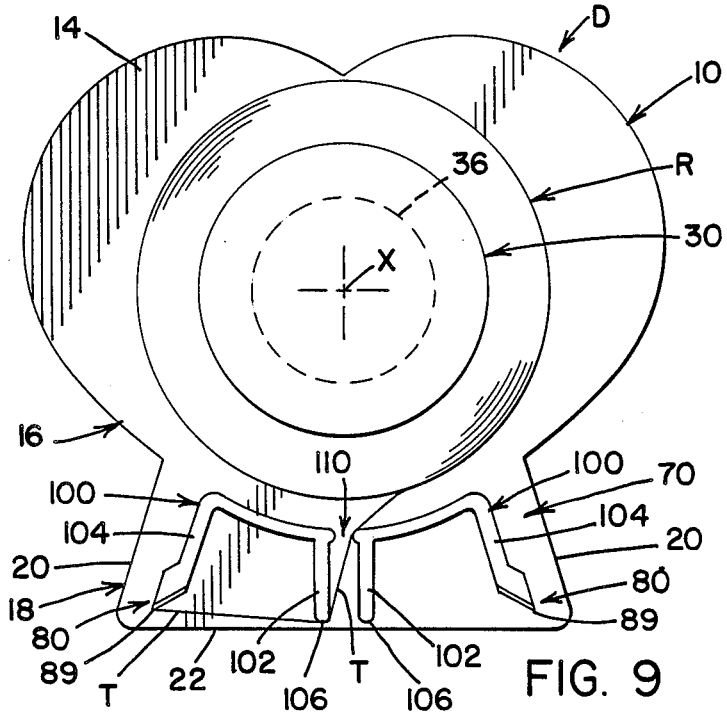

Referring now to FIG. 9, there is shown a further alternate embodiment of tape dispenser D wherein base means 70 comprises a pair of generally U-shaped base members 100 extending rearwardly from wall member 10 below tape roll holding means 30 and facing vertically downward. Each U-shaped member 100 has an arm 102 and an arm 104 of the U-shape. Arms 102 are each adapted to provide a foot 106. In this embodiment cutting means 80 is associated with base means 70 to provide a cutting edge 89 at the end of each arm 104. Arms 102 are disposed vertically, are generally parallel, and are spaced apart a distance sufficient to form a vertical passage 110 through which an unwound length of tape T extends. Base members 100 may be formed with a curvature as shown in FIG. 9 to correspond with the shape of a tape roll held on tape dispenser D.

When in use, tape dispenser D can be held in one hand while the tape roll is unwound with the other hand, can be mounted by means of magnet 62 on an office filing cabinet wall or a home refrigerator door, as shown in FIG. 5, or can be stood upright on a desk or table top, as shown in FIG. 6.

In use, tape dispenser D is adapted to provide access to tape T from the front of the tape dispenser such that ornamental front side 12 of wall member 10 remains in view without the need to turn the tape dispenser around to view the components found at the rear side 14 of wall member 10. Furthermore, tape dispenser D is adapted to accommodate whichever direction of tape withdrawal is desired by either a right or left handed user.

In the embodiment shown in FIG. 2, converging side edges 20 of wall member 10 permit a user's fingers to reach between upper section 16 and lower section 18 of wall member 10 to grasp an unwound length of tape T held between cutting edges 82 and roll R. Retainer means 42 is releaseable from tape dispenser D with releaseable sleeve 36 whereby tape roll R can be manually reversed to the position shown in FIG. 7, whereby access to the tape is provided on the opposite side.

In the embodiment shown in FIG. 8, a user's fingers may reach from below, particularly when the tape dispenser is wall mounted, between cutting arms 86 and base members 94 to grasp or pinch an unwound length of tape held between a cutting edge 88 and tape roll R. Such pinching action releases the tape end from the cutting edge to which it has adhered, whereby further lengths of tape T can be withdrawn through slot 84 and between cutting arms 86 and cutting edges 88. The tape may be cut off in a direction towards either cutting edge.

In the embodiment shown in FIG. 9, a length of tape T is directed to extend from roll R through vertical passage 110 around a foot 106 to a cutting edge 89. A length of tape extending from either foot to either cutting edge may be reached from below and further withdrawn in a direction downward from vertical passage 110, whereupon the withdrawn length may be cut off in a direction towards either cutting edge. Alternatively with the dispenser adhering to a vertical surface, the length of tape may be left hanging downwardly from the slot defined by Feet 106 and available to the user when he next desires a length of tape.

The invention has been described with reference to the preferred embodiment. Obviously modifications and alterations will occur to others upon the reading and understanding of this specification. It is intended to include all such modifications and alterations insofar as they come within the scope of the appended claims or equivalents thereof.

Having thus described the invention, it is claimed:

1. A tape dispenser adapted to hold a roll of tape comprising a generally planar vertical wall member having a front and a rear side;

tape roll holding means disposed at said rear side and adapted to permit said tape roll to unwind about an axis perpendicular to said wall member;

base means disposed vertically below said tape roll holding means and comprising a rearwardly extending member having a generally arcuate cross-section in a plane parallel to said wall member such that the arcuate extremities thereof form two parallel feet extending rearwardly from said wall member, said feet being adapted to support said tape dispenser in an upright free standing position; and tape cutting means comprising a slot formed in said rearwardly extending member in a direction perpendicular to said wall member dividing said base member into two adjacent arcuate segments, said slot providing a passage through which an unwound length of said tape roll extends, a pair of cutting bars extending rearwardly from said front wall beneath said slot and being disposed on opposite sides of a plane passing through said slot, said cutting bars each having a tape cutting edge disposed opposite the other whereby said unwound length of said tape extends through said slot and between said cutting edges, with sufficient distance being provided between said segments of said base member and said cutting bars to permit a user's fingers to grasp said unwound length of said tape between said slot and said cutting bars.

2. A tape dispenser adapted to hold a roll of tape comprising a generally planar vertical wall member having a front and a rear side;

tape roll holding means disposed at said rear side and adapted to permit said tape roll to unwind about an axis perpendicular to said wall member;

tape cutting means comprising a pair of cutting edges;

base means disposed vertically below said tape roll holding means and comprising a pair of generally U-shaped members extending rearwardly from said wall member and facing vertically downward, each U-shaped member having, a foot formed at an end of one arm of said U-shaped member and having one of said tape cutting edges formed, at an end of the other arm of said U-shaped member, said being adapted to support said tape dispenser in a free standing upright position, and said arms having feet formed thereon being disposed adjacent one another and spaced apart to provide a vertical passage therebetween through which an unwound length of said tape extends.

3. A tape dispenser adapted to hold a roll of tape comprising a generally planar wall member having a front and a rear side;

tape roll holding means disposed at said rear side and adapted to permit said tape roll to unwind about an axis perpendicular to said wall member;

base means disposed vertically below said tape roll holding means and comprising a rearwardly extending member having a generally arcuate cross-section in a plane parallel to said wall member, the arcuate extremities thereof forming feet being adapted to support said tape dispenser in an upright free standing position; and, tape cutting means comprising a pair of tape cutting edges each disposed parallel to and vertically above one of said feet.

4. A tape dispenser adapted to hold a roll of adhesive tape comprising a generally planar vertical wall member having a front and rear side;

tape roll holding means disposed at said rear side;

wall mounting means associated with said tape roll holding means;

base means disposed at said rear side;

tape cutting means associated with said base means;

said tape roll holding means comprising a horizontal cylindrical hub component extending rearwardly from said rear side of said wall member and having a retainer means at the rear end thereof, said retainer means being adapted to releaseably hold said roll of adhesive tape on said hub component between said rear side of said wall member and said retainer means with said roll being rotatable about said hub component in a plane parallel to said wall member, and spring means adapted to bias said roll of adhesive tape axially along said hub component whereby said roll resides in an axially stationary position along said hub component; and, said wall mounting means comprises a flat magnetic surface associated with said retainer means.

5. A tape dispenser adapted to hold a roll of adhesive tape comprising a generally planar vertical wall member having a front and rear side;

tape roll holding means disposed at said rear side;

wall mounting means associated with said tape roll holding means;

base means disposed at said rear side;

tape cutting means associated with said base means;

said tape roll holding means comprising a horizontal cylindrical hub component extending rearwardly from said rear side of said wall member and having a retainer means at the rear end thereof, said retainer means being adapted to releaseably hold said roll of adhesive tape on said hub component between said rear side of said wall member and said retainer means with said roll being rotatable about said hub component in a plane parallel to said wall member, and a washer around said hub component adapted to hold said roll of adhesive tape axially stationary along said hub component; and, said wall mounting means comprises a flat magnetic surface associated with said retainer means.

6. A tape dispenser adapted to hold a roll of adhesive tape comprising a generally planar vertical wall member having a front and rear side;

tape roll holding means disposed at said rear side;

wall mounting means associated with said tape roll holding means;

base means disposed at said rear side;

tape cutting means associated with said base means;

said tape roll holding means being adapted to permit said tape roll to unwind about an axis perpendicular to said wall member;

said base means being disposed vertically below said tape roll holding means and comprising a rearwardly extending member having a generally arcuate cross-section in a plane parallel to said wall member such that the arcuate extremities thereof form two parallel feet extending rearwardly from said wall member, said feet being adapted to support said tape dispenser in an upright free standing position; and, said tape cutting means comprising a slot formed in said rearwardly extending member in a direction perpendicular to said wall member dividing said base member into two adjacent arcuate segments, said slot providing a passage through which an unwound length of said tape extends, and a pair of cutting bars extending rearwardly from said front wall beneath said slot and being disposed on opposite sides of a plane passing through said slot, said cutting bars each having a tape cutting edge disposed opposite the other whereby said unwound length of said tape extends through said slot and between said cutting edges.

7. A tape dispenser adapted to hold a roll of adhesive tape comprising a generally planar vertical wall member having a front and rear side;

tape roll holding means disposed at said rear side;

wall mounting means associated with said tape roll holding means;

base means disposed at said rear side;

tape cutting means associated with said base means;

said tape roll holding means being adapted to permit said tape roll to unwind about an axis perpendicular to said wall member;

said base means being disposed vertically below said tape roll holding means and comprising a rearwardly extending member having a generally arcuate cross-section in a plane parallel to said wall member such that the arcuate extremities thereof form two parallel feet extending rearwardly from said wall member, said feet being adapted to support said tape dispenser in an upright free standing position; and, said tape cutting means comprising a slot formed in said rearwardly extending member in a direction perpendicular to said wall member dividing said base member into two adjacent arcuate segments, said slot providing a passage through which an unwound length of said tape extends, and a pair of cutting bars extending rearwardly from said front wall beneath said slot and being disposed on opposite sides of a plane passing through said slot, said cutting bars each having a tape cutting edge disposed opposite the other whereby said unwound length of said tape extends through said slot and between said cutting edges, sufficient distance being provided between said segments of said base member and said cutting bars to permit a user's fingers to grasp said unwound length of said tape between said slot and said cutting bars.

8. A tape dispenser adapted to hold a roll of adhesive tape comprising a generally planar vertical wall member having a front and rear side;

tape roll holding means disposed at said rear side;

wall mounting means associated with said tape roll holding means;

base means disposed at said rear side;

tape cutting means associated with said base;

said tape roll holding means being adapted to permit said tape roll to unwind about an axis perpendicular to said wall member;

said tape cutting means comprising a pair of cutting edges; and, said base means being disposed vertically below said tape roll holding means and comprising a pair of generally U-shaped members extending rearwardly from said wall member and facing vertically downward, each U-shaped member having a foot formed at one end of one arm of said U-shape and having one of said tape cutting edges formed at the end of the other arm of said U-shape, said feet being adapted to support said tape dispenser in a free standing upright position, and said arms having feet formed thereon being disposed adjacent one another and spaced apart to provide a vertical passage therebetween through which an unwound length of said tape extends.

9. A tape dispenser adapted to hold a roll of adhesive tape comprising a generally planar vertical wall member having a front and rear side;

tape roll holding means disposed at said rear side;

wall mounting means associated with said tape roll holding means;

base means disposed at said rear side;

tape cutting means associated with said base means;

said tape roll holding means being adapted to permit said tape roll to unwind about an axis perpendicular to said wall member;

said base means being disposed vertically below said tape roll holding means and comprising a rearwardly extending member having a generally arcuate cross-section in a plane parallel to said wall member such that the arcuate extremities thereof form two parallel feet extending rearwardly from said wall member, said feet being adapted to support said tape dispenser in an upright free standing position; and, said tape cutting means comprising a slot formed in said rearwardly extending member in a direction perpendicular to said wall member dividing said base member into two adjacent arcuate segments, said slot providing a passage through which an unwound length of said tape extends, and a pair of cutting bars extending rearwardly from said front wall beneath said slot and being disposed on opposite sides of a plane passing through said slot, said cutting bars each having a tape cutting edge disposed opposite the other whereby said unwound length of said tape extends through said slot and between said cutting edges, said tape cutting means being formed integrally with said base means.

10. A tape dispenser comprising a base portion adapted to support said dispenser on a horizontal surface and having at least one cutting edge disposed thereon adapted to separate lengths of tape from a standard roll of tape disposed in said dispenser;

a cylindrical hub portion adapted to support said standard roll of tape;

a generally planar front wall portion rigidly interconnecting said base portion and said hub portion;

a retainer portion adapted to be releaseably fixed to said hub portion thereby retaining said standard roll of tape on said hub portion, said retainer portion comprising attachment means interacting with said hub portion and a flat flange defining a circular area larger than the cross-sectional area of said hub portion and a flat outer surface substantially parallel to said front wall;

a magnet fixed to said retainer adapted to hold said retainer flat outer surface against a metallic surface;

said base comprising two parallel, adjacent cutting edges spaced apart to define a central bottom slot between said cutting edges and through which said length of tape extends, and two rearwardly extending support portions adapted to support said tape dispenser in contact with said horizontal surface, said support portions being disposed outwardly of said cutting edges a distance sufficient to allow one's fingertips to reach between said support portions and said cutting edges to grasp said tape upwardly of said cutting edges.

11. A tape dispenser comprising a base portion adapted to support said dispenser on a horizontal surface and having at least one cutting edge disposed thereon adapted to separate lengths of tape from a standard roll of tape disposed in said dispenser;

a cylindrical hub portion adapted to support said standard roll of tape;

a generally planar front wall portion rigidly interconnecting said base portion and said hub portion;

a retainer portion adapted to be releaseably fixed to said hub portion thereby retaining said standard roll of tape on said hub portion, said retainer portion comprising attachment means interacting with said hub portion and a flat flange defining a circular area larger than the cross-sectional area of said hub portion and a flat outer surface substantially parallel to said front wall;

a magnet fixed to said retainer adapted to hold said retainer flat outer surface against a metallic surface, said base comprising two parallel, adjacent cutting edges spaced apart to define a central bottom slot between said cutting edges and through which said length of tape extends, and two rearwardly extending support portions adapted to support said tape dispenser in contact with said horizontal surface, said support portions being disposed outwardly of said cutting edges a distance sufficient to allow one's fingertips to reach between said support portions and said cutting edges to grasp said tape upwardly of said cutting edges, said two support portions being arcuate segments defining an upper tape guide slot disposed between said hub and said cutting edges.

12. A tape dispenser comprising a base portion adapted to support said dispenser on a horizontal surface and having at least one cutting edge disposed thereon adapted to separate lengths of tape from a standard roll of tape disposed in said dispenser;

a cylindrical hub portion adapted to support said standard roll of tape;

a generally planar front wall portion rigidly interconnecting said base portion and said hub portion;

a retainer portion adapted to be releaseably fixed to said hub portion thereby retaining said standard roll of tape on said hub portion, said retainer portion comprising attachment means interacting with said hub portion and a flat flange defining a circular area larger than the cross sectional area of said hub portion and a flat outer surface substantially parallel to said front wall;

a magnet fixed to said retainer adapted to hold said retainer flat outer surface against a metallic surface, said base comprising two parallel, adjacent cutting edges spaced apart to define a central bottom slot between said cutting edges and through which said length of tape extends, and two rearwardly extending support portions adapted to support said tape dispenser in contact with said horizontal surface, said support portions being disposed outwardly of said cutting edges a distance sufficient to allow one's fingertips to reach between said support portions and said cutting edges to grasp said tape upwardly of said cutting edges, said two support portions being arcuate segments defining an upper tape guide slot disposed between said hub and said cutting edges, said support portions extending rearwardly from said front wall portion a distance equal to the distance between said front wall portion and said flat outer surface of said retainer portion.

13. A tape dispenser adapted to hold a roll of adhesive tape comprising:

a generally planar vertical wall member having front and rear sides;

tape roll holding means disposed at said rear side and adapted to permit said tape roll to unwind about an axis perpendicular to said wall member;

wall mounting means associated with said tape roll holding means;

base means disposed at said rear side and adapted to support said tape dispenser in a free standing position, said base means being disposed vertically below said tape roll holding means and comprising a rearwardly extending member having a generally arcuate cross section in a plane parallel to said wall member such that the arcuate extremities form two parallel feet extending rearwardly from said wall member, said feet being adapted to support said tape dispenser in an upright, free standing position; and, tape cutting means associated with said base means and comprising a pair of tape cutting edges each disposed parallel to and vertically above one of said feet.

14. A tape dispenser as defined in claim 13 which tape cutting means is formed integrally with said means.

15. A tape dispenser comprising:

a base portion adapted to support said dispenser on a horizontal surface and having at least two cutting edges disposed thereon and adapted to separate lengths of tape from a standard roll of tape disposed in said dispenser, said cutting edges comprising two parallel adjacent cutting edges spaced apart to define a central bottom slot between said cutting edges and through which said length extends, and two rearwardly extending support portions adapted to support said tape dispenser in contact with said horizontal surface, said support portions being disposed outwardly of said cutting edges a distance sufficient to allow one's fingertips to reach between said support portions and said cutting edges to grasp said tape upwardly of said cutting edges;

a cylindrical hub portion having an axis adapted to support said standard roll of tape;

a generally planar front wall portion rigidly interconnecting said base portion and said hub portion;

a retainer portion adapted to be axially shiftable into and out of a position releasably fixed to said hub portion thereby retaining said standard roll of tape on said hub portion, said retainer portion comprising attachment means interacting with said hub portion and a flat flange defining a circular area larger than the cross sectional area of said hub portion and a flat outer surface substantially parallel to said front wall, said flange being structurally separate from said front wall portion when said retainer portion is in said fixed position; and, a magnet fixed to said retainer and adapted to said retainer flat outer surface against a metallic surface.

16. A tape dispenser as defined in claim 15 wherein said two support portions are arcuate segments defining an upper tape guide slot disposed between said hub and said cutting edges.

17. A tape dispenser as defined in claim 16 wherein said two support portions extend rearwardly from said front wall portion a distance equal to the distance between said front wall portion and said flat, outer surface of said retainer portion.

* * * * *